US006422141B2

(12) United States Patent
Yoshida

(10) Patent No.: US 6,422,141 B2
(45) **Date of Patent: *Jul. 23, 2002**

(54) MULTI-COLOR OFFSET PRINTING METHOD AND APPARATUS

(75) Inventor: Takumi Yoshida, Kyoto (JP)

(73) Assignee: Dainippon Screen Mfg. Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,124

(22) Filed: Aug. 24, 1999

(30) Foreign Application Priority Data

Sep. 9, 1998 (JP) ..... 10-274422

(51) Int. Cl.[7] ..... B41M 1/14; B41F 5/16

(52) U.S. Cl. ..... 101/211; 101/492; 101/177; 101/217; 101/246

(58) Field of Search ..... 101/177, 217, 101/246, 211, 490, 492

(56) References Cited

U.S. PATENT DOCUMENTS 4,854,232 A 8/1989 Oda

FOREIGN PATENT DOCUMENTS

| | | |
|---|---|---|
| DE | 3313219 A1 | 10/1984 |
| EP | 0 639 452 A1 | 2/1995 |
| EP | 0 867 279 | 9/1998 |

*Primary Examiner*—Eugene Eickholt
(74) *Attorney, Agent, or Firm*—Arent Fox Kintner Plotkin & Kahn PLLC

(57) ABSTRACT

A multi-color offset printing apparatus includes first and second plate cylinders 11 and 12 each having a plate mounted peripherally thereof, the plate defining two image areas, first and second blanket cylinders 13 and 14 equal in diameter to the first and second plate cylinders 11 and 12 and rotatable in contact with the first and second plate cylinders 11 and 12, respectively, and an impression cylinder 15 having a gripper 83 disposed peripherally thereof for holding a forward end of printing paper, the impression cylinder 15 being rotatable in contact with the first and second blanket cylinders 13 and 14. In this multi-color offset printing apparatus, the impression cylinder 15 is rotated at least four times, with the printing paper held in place by the gripper 83, before starting a printing operation. This step creates a state of ink saturation on the first and second blanket cylinders 13 and 14 prior to the printing operation.

9 Claims, 10 Drawing Sheets

MULTI-COLOR OFFSET PRINTING METHOD AND APPARATUS

BACKGROUND OF THE INVENTION

1. Field of the Invention

The present invention relates to a multi-color offset printing method and apparatus.

2. Description of the Related Art

A multi-color offset printing apparatus performs multi-color offset printing by feeding color inks to a plurality of corresponding plates mounted on a plate cylinder, transferring the inks to a blanket cylinder, and thereafter transferring the inks from the blanket cylinder to printing paper in a predetermined order of colors.

Such a multi-color offset printing apparatus has a drawback that, at a stage immediately following the start of a printing operation, print quality is destabilized by a phenomenon known as "back trapping".

Specifically, in a multi-color offset printing apparatus for printing with four color inks, for example, blankets corresponding to the four color inks successively contact printing paper to produce multi-color prints. After the first color ink is transferred from its blanket to the printing paper, the printing paper successively contacts the other blankets to receive the second, third and fourth color inks therefrom. Then, the first color ink is transferred from the printing paper back to the blankets of the second, third and fourth color inks. Similarly, the second color ink is transferred from the printing paper back to the blankets of the third and fourth color inks as these blankets successively contact the printing paper to transfer the third and fourth color inks. Further, the third color ink is transferred from the printing paper back to the blanket of the fourth color ink as this blanket contacts the printing paper to transfer the fourth color ink.

Consequently, by the time a four color printing operation is completed, the first to third color inks have been applied to the printing paper in smaller quantities than are required to attain a desired printing result.

In printing on a plurality of sheets of printing paper, such a phenomenon continues until the second to fourth blankets become saturated with the inks as a result of the first to third color inks transferred back thereto in certain quantities. Thus, numerous sheets of printing paper are wasted before the blankets are saturated with the inks.

To solve this problem, Applicant has proposed a multi-color offset printing method disclosed in U.S. Pat. No. 4,854,232. According to this method, a state of saturation may be created before starting a printing operation, by transferring beforehand each preceding color ink from its plate to a blanket or blankets of a succeeding color or colors.

However, this multi-color offset printing method is applicable only to a printing apparatus constructed for causing the printing plate of each preceding color to contact the blankets of succeeding colors. It is impossible to apply this method to a printing apparatus having no such construction.

SUMMARY OF THE INVENTION

The object of the present invention, therefore, is to provide a multi-color offset printing method and apparatus effective to prevent a wasteful use of printing paper occurring immediately after the start of a printing operation.

The above object is fulfilled, according to the present invention, by a multi-color offset printing method for performing multi-color printing by feeding color inks, respectively, to a plurality of corresponding plates mounted on a plate cylinder, transferring the color inks through a blanket cylinder to printing paper in a predetermined order of colors, the method comprising an ink feeding step for feeding the color inks from ink feeders opposed to the plate cylinder with plates mounted peripherally thereof and defining n (n being an integer 2 or more) image areas, the color inks fed corresponding in color to the image areas, respectively; an ink transferring step for transferring the color inks from the plates to the blanket cylinder equal in diameter to the plate cylinder and rotating in contact with the plate cylinder; an ink adjusting step for rotating an impression cylinder at least 2 n times, the impression cylinder having a sheet mounted peripherally thereof and rotating in contact with the blanket cylinder; and a printing step for feeding printing paper to an outer periphery of the impression cylinder rotating in contact with the blanket cylinder, and discharging the printing paper from the outer periphery of the impression cylinder after rotating the impression cylinder n times.

With this multi-color offset printing method, a state of ink saturation is created on the blanket cylinder prior to a printing operation. This feature is effective to prevent a wasteful use of printing paper occurring immediately after the start of a printing operation.

In a preferred embodiment of the invention, the ink transferring step is executed for causing only one of the image areas corresponding to a succeeding one of the color inks in the order of colors to contact the blanket cylinder.

In another aspect of the invention, a multi-color offset printing method is provided for performing multi-color printing by feeding color inks, respectively, to a plurality of corresponding plates mounted on plate cylinders, transferring the inks through blanket cylinders to printing paper in a predetermined order of colors, the method comprising a first ink feeding step for feeding the color inks from ink feeders opposed to a first plate cylinder with a plate mounted peripherally thereof and defining m (m being an integer 1 or more) image areas, the color inks fed corresponding in color to the image areas, respectively; a second ink feeding step for feeding the color inks from ink feeders opposed to a second plate cylinder with a plate mounted peripherally thereof and defining m image areas, the color inks fed corresponding in color to the image areas, respectively; a first ink transferring step for transferring the color inks from the plate mounted peripherally of the first plate cylinder to a first blanket cylinder equal in diameter to the first plate cylinder and rotating in contact with the first plate cylinder; a second ink transferring step for transferring the color inks from the plate mounted peripherally of the second plate cylinder to a second blanket cylinder equal in diameter to the second plate cylinder and rotating in contact with the second plate cylinder; an ink adjusting step for rotating an impression cylinder at least 2 m times, the impression cylinder having a sheet mounted peripherally thereof and rotating in contact with the first blanket cylinder and the second blanket cylinder; and a printing step for feeding printing paper to an outer periphery of the impression cylinder rotating in contact with the first blanket cylinder and the second blanket cylinder, and discharging the printing paper from the outer periphery of the impression cylinder after rotating the impression cylinder m times.

In a further aspect of the invention, a multi-color offset printing apparatus is provided for performing multi-color printing by feeding color inks, respectively, to a plurality of corresponding plates mounted on a plate cylinder, transferring the color inks through a blanket cylinder to printing paper in a predetermined order of colors, the apparatus comprising a plate cylinder with plates mounted peripherally thereof and defining n (n being an integer 2 or more) image areas; a blanket cylinder equal in diameter to the plate cylinder and rotatable in contact with the plate cylinder; an impression cylinder having a gripper disposed peripherally thereof for holding a forward end of printing paper, the impression cylinder being rotatable in contact with the blanket cylinder; and a controller for rotating the impression cylinder at least 2 n times, with the gripper holding a sheet.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
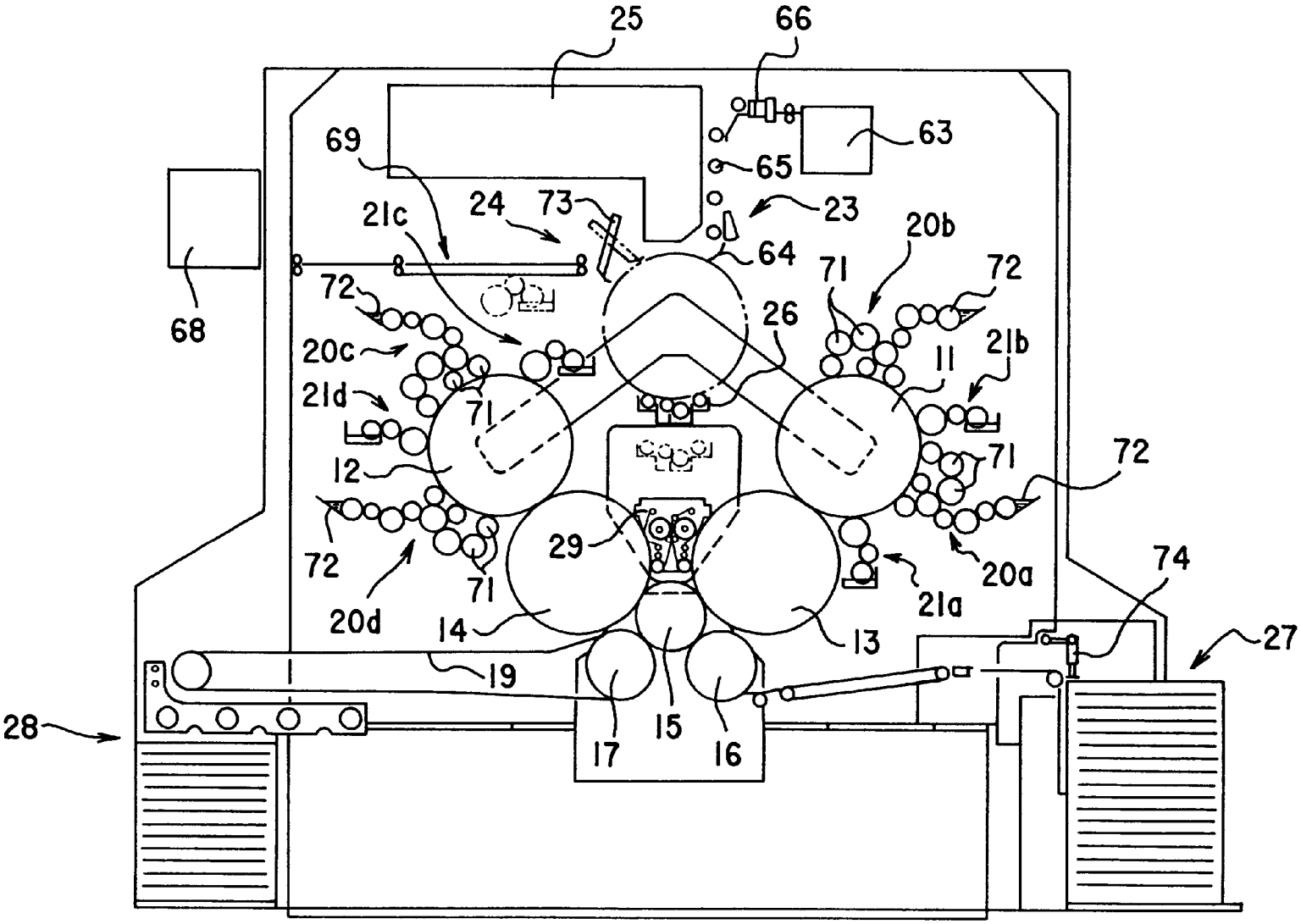
FIG. 1 is a schematic side view of a multi-color offset printing apparatus according to the present invention.

Embodiments of the present invention will be described hereinafter with reference to the drawings. FIG. 1 is a schematic side view of a multi-color offset printing apparatus according to the present invention.

This printing apparatus records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is rotatable synchronously with the first blanket cylinder 13. In the second printing position, the second plate cylinder 12 is rotatable synchronously with-the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, and a conveyor mechanism 69 for transporting the plate separated by the pawl mechanism 73 to a discharge cassette 68.

The forward end of the plate drawn from the feeder cassette 63 is guided the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
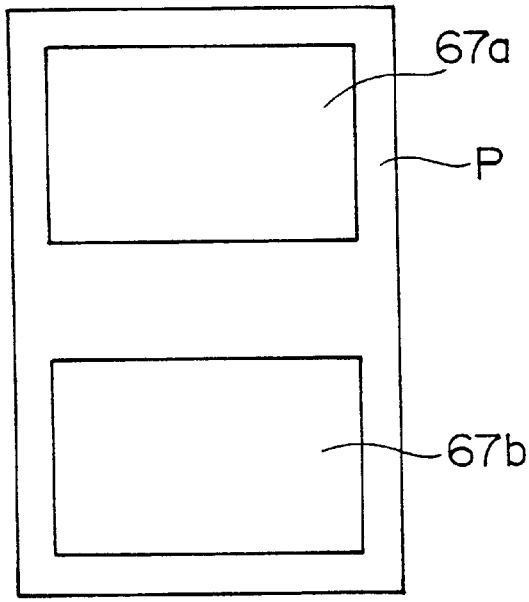
FIGS. 2A and 2B are explanatory views each showing an arrangement of image areas on a plate.
Figure 2B:
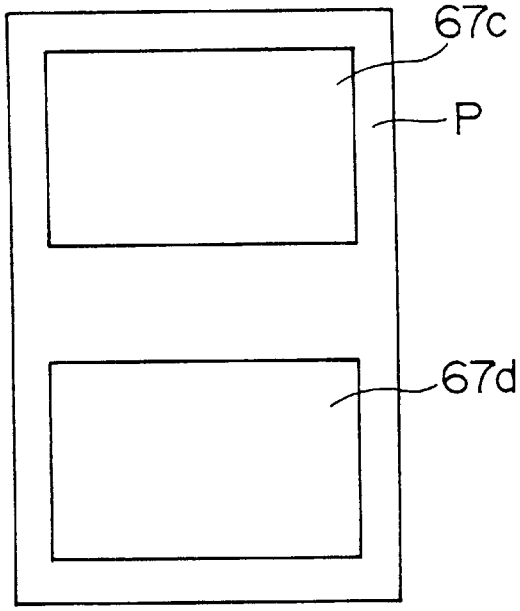

On the plate P mounted peripherally of the first plate cylinder 11, the image recorder 25, as shown in FIG. 2A, records an image area 67*a* to be printed with black ink, and an image area: 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Figure 3:
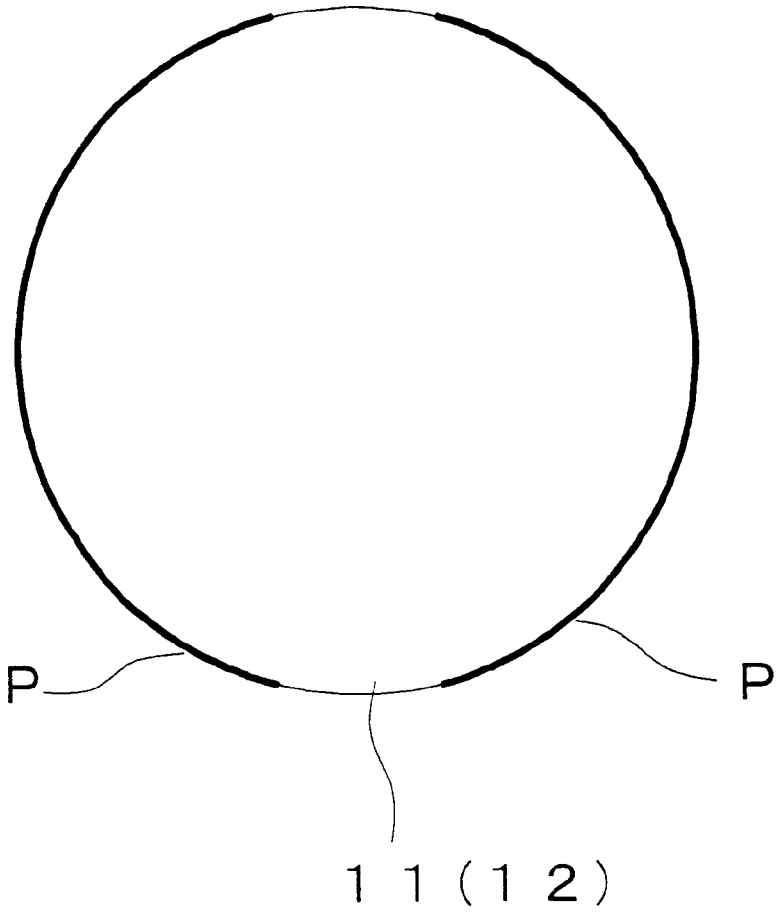
FIG. 3 is a schematic view showing two plates, each having a single image area, mounted peripherally of a plate cylinder.

In the foregoing embodiment, two image areas 67*a* and 67*b* or 67*c* and 67*d* are provided on the single plate P mounted peripherally of the first or second plate cylinder 11 or 12, in order to simplify the structure of the first or second plate cylinder 11 or 12. Alternatively, the first or second plate cylinder 11 or 12 may include two sets of grippers, each set for holding the forward and rear ends of one plate P. Then, as shown in FIG. 3, each of the first and second plate cylinders 11 and 12 may support two plates P each having a single image area. As used herein, the term "holding a plate having two image areas" should be interpreted to include the case of holding a single plate having two image areas and the case of holding two plates each having a single image area. In the latter case also, the two plates P should be held as evenly separated on the first or second plate cylinder 11 or 12, so that the image areas recorded on the respective plates are in evenly separated positions, i.e. in positions separated from each other by 180 degrees.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an inkwell 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

The dampening water feeders 21*a*, 21*b*, 21*c* and 21*d* (which may be referred to collectively as "dampening water feeders 21") feed dampening water to the plates P before the ink feeders 20 feed the inks thereto. Of these dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

The developing device 26 is disposed under the first or second plate cylinder 11 or 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper 83 (FIG. 7), which will be described hereinafter, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper 83 of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers arranged thereon. When the impression cylinder 15 transfers the printing paper to the discharge cylinder 17, one of the grippers of the discharge cylinder 17 holds the forward end of the printing paper having been held by the gripper 83 of the impression cylinder 15. With movement of the chains 19, the printing paper is transported to the paper discharge station 28 to be discharged therein.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 4:
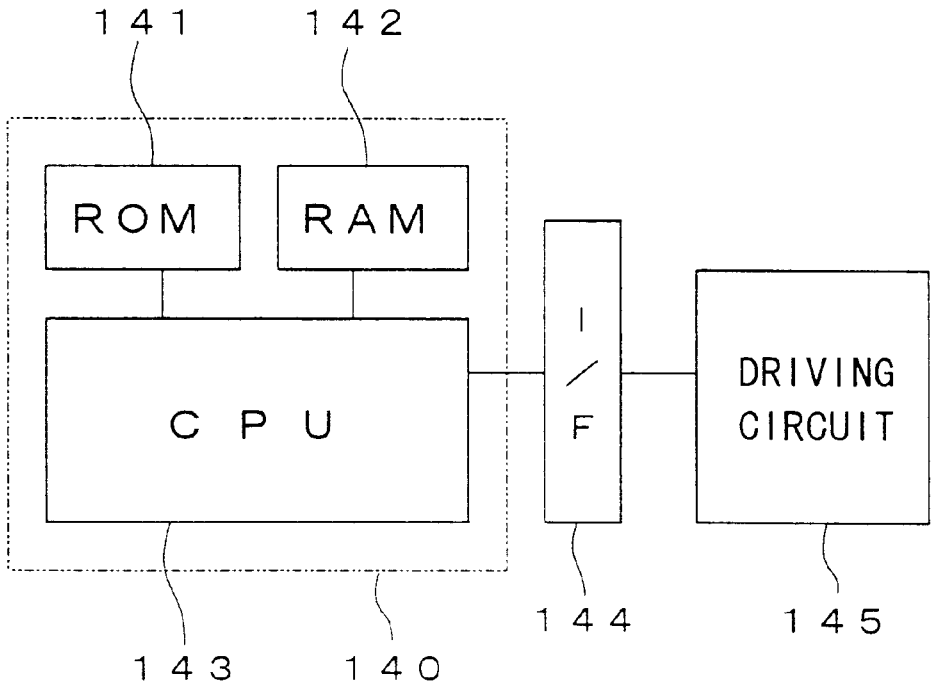
FIG. 4 is a block diagram showing a principal electrical structure of the printing apparatus.

FIG. 4 is a block diagram showing a principal electrical structure of the multi-color offset printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, image recorder 25, developing device 26, blanket cleaning unit 29, the moving mechanisms for moving the first and second plate cylinders 11 and 12, the contact mechanisms for the first and second blanket cylinders 13 and 14, a mechanism for opening and closing the gripper 83 of impression cylinder 15, and so on. The printing apparatus is controlled by the control unit 140 to execute prepress and printing operations as described hereinafter.

Figure 5:
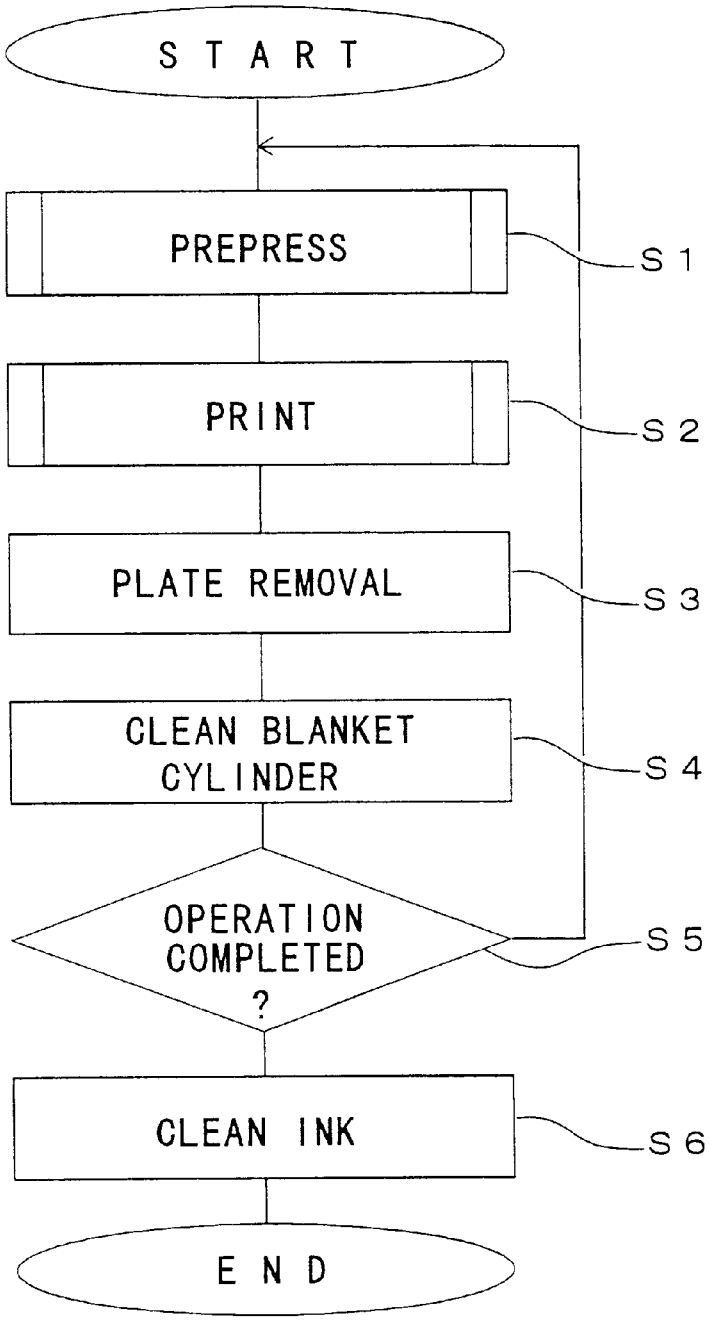
FIG. 5 is a flow chart showing an outline of prepress and printing operations of the printing apparatus.

The prepress and printing operations of the multi-color offset printing apparatus will be described next. FIG. 5 is a flow chart showing an outline of the prepress and printing operations of the printing apparatus. These prepress and printing operations exemplify multi-color printing performed on printing paper by using the four color inks of yellow, magenta, cyan and black.

Figure 6:
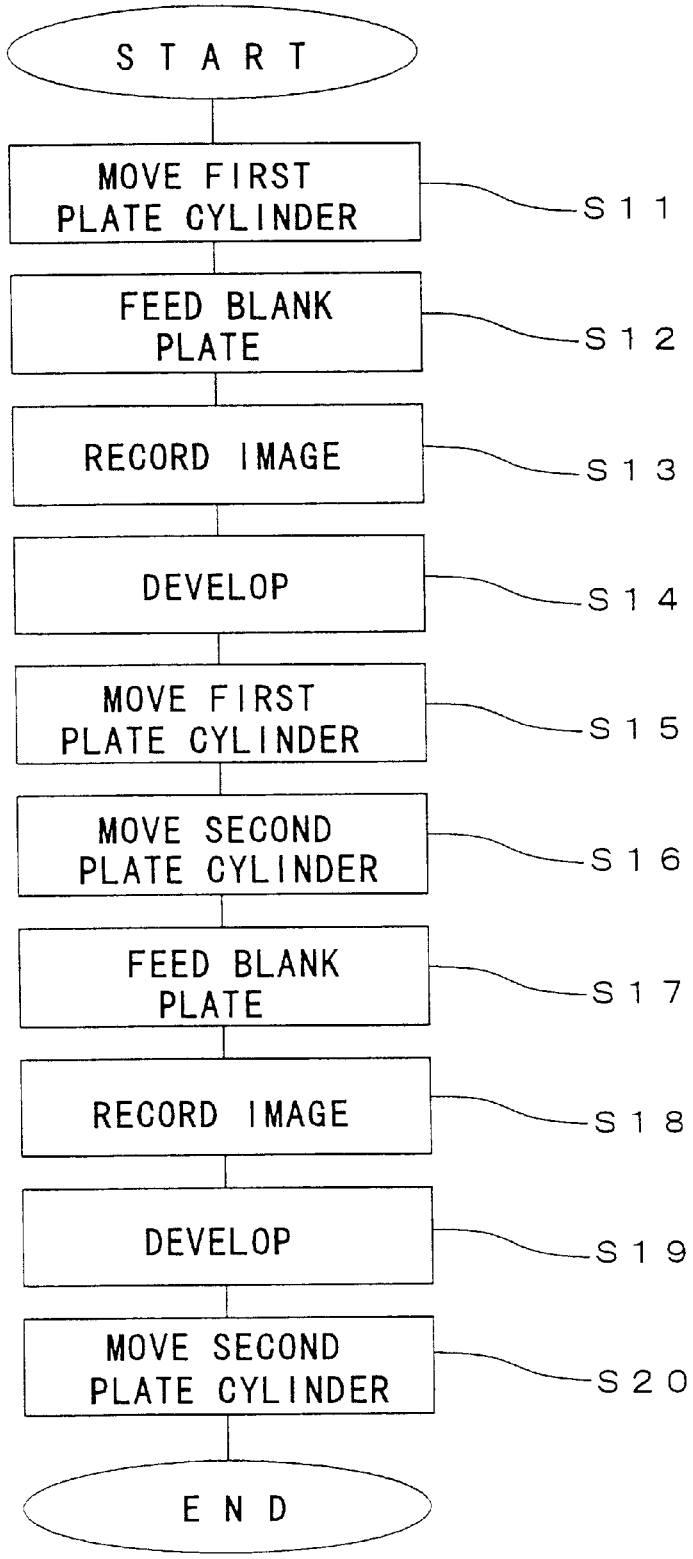
FIG. 6 is a flow chart of a prepress process.

First, the printing apparatus executes a prepress process for recording and developing images on the plates P mounted on the first and second plate cylinders 11 and 12 (step S1). This prepress process follows the steps constituting a subroutine as shown in the flow chart of FIG. 6.

The first plate cylinder 11 is first moved to the image recording position shown in a two-dot chain line in FIG. 1. (step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-edot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing apparatus carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 5, the prepress process is followed by a printing process for printing the printing paper with the plates P mounted on the first and second plate cylinders 11 and 12 (step S2).

Prior to the printing process, an ink transfer process and an ink adjusting process according to the present invention have to be carried out in order to prevent a wasteful use of printing paper occurring immediately after the start of printing. These ink transfer process and ink adjusting process will be described in detail hereinafter.

The printing process is performed as follows. First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, printing paper is fed to the paper feed cylinder 16. The printing paper is subsequently passed from the paper feed cylinder 16 to the impression cylinder 15. The impression cylinder 15 continues rotating in this state. As noted hereinbefore, the impression cylinder 15 has half the diameter of the first and second plate cylinders 11 and 12 and the first and second blanket cylinders 13 and 14. Thus, with a first rotation of the impression cylinder 15, the black and cyan inks are transferred to the printing paper held peripherally thereof. With a second rotation of the impression cylinder 15, the magenta and yellow inks are transferred to the printing paper.

The forward end of the printing paper printed in the four colors as described above is passed from the impression cylinder 15 to the paper discharge cylinder 17. Then, the printing paper printed is transported by the pair of chains 19 to the paper discharge station 28 along with one of the grippers of the paper discharge cylinder 17, to be discharged therein.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing apparatus determines whether or not a further image is to be printed (step S5). If a further printing operation is required, the apparatus repeats steps S1 to S4.

If the printing operation is ended, the printing apparatus cleans the inks (step S6). For cleaning the inks, an ink cleaning device, not shown, provided for each ink feeder 20 removes the ink adhering to the ink rollers 71 and inkwell 72 of each ink feeder 20.

With completion of the ink cleaning step, the printing apparatus ends the entire process.

Figure 7:
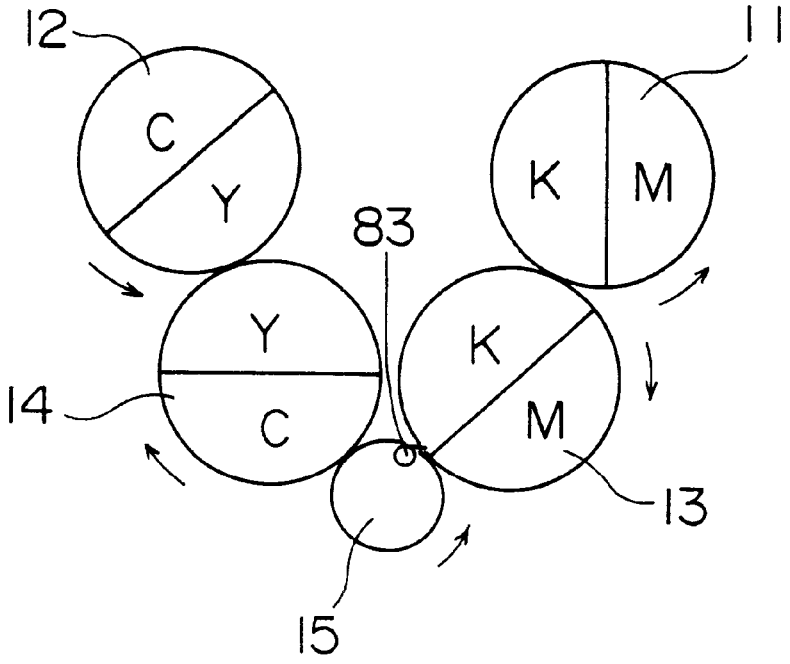
FIG. 7 is a schematic view showing a first and a second plate cylinders, a first and a second blanket cylinders and an impression cylinder of the printing apparatus according to the present invention.

FIG. 7 is a schematic view showing the first and second plate cylinders 11 and 12, the first and second blanket cylinders 13 and 14 and the impression cylinder 15 of the above multi-color offset printing apparatus. Numeral 83 in this figure denotes the gripper noted hereinbefore, which is disposed peripherally of the impression cylinder 15 for holding the forward end of printing paper.

In FIG. 7, for expediency of illustration, reference K is affixed to regions of the first plate cylinder 11 and first blanket cylinder 13 used for printing with black ink (which will be hereinafter called "K regions", as necessary), reference M to regions of the first plate cylinder 11 and first blanket cylinder 13 used for printing with magenta ink (which will be hereinafter called "M regions", as necessary), reference C to regions of the second plate cylinder 12 and second blanket cylinder 14 used for printing with cyan ink (which will be hereinafter called "C regions", as necessary), and reference Y to regions of the second plate cylinder 12 and second blanket cylinder 14 used for printing with yellow ink (which will be hereinafter called "Y regions", as necessary).

When this multi-color offset printing apparatus prints printing paper mounted peripherally of the impression cylinder 15 by applying the inks thereto in the order of black (K), cyan (C), magenta (M) and yellow (Y), for example, the black ink on the printing paper is transferred back to the regions of the first and second blanket cylinders 13 and 14 used for printing with the cyan, magenta and yellow inks. The cyan ink on the printing paper is transferred back to the regions of the first and second blanket cylinders 13 and 14 used for printing with the magenta and yellow inks. Similarly, the magenta ink on the printing paper is transferred back to the region of the second blanket cylinder 14 used for printing with the yellow ink.

Thus, the phenomenon known as "back trapping" causes a drawback of destabilizing print quality at a stage immediately following the start of a printing operation. In the course of printing numerous sheets of printing paper, this phenomenon continues until the inks are transferred back to the first and second blanket cylinders 13 and 14 in quantities reaching a point of saturation.

To avoid such a situation, the multi-color offset printing apparatus according to this invention is constructed for executing an ink adjusting process upon start of a printing operation. In this process, the impression cylinder 15 is rotated a plurality of times, e.g. at least four times, with the printing paper held in place by the gripper 83.

This multi-color offset printing apparatus provides a four-color print by rotating the impression cylinder twice. When the impression cylinder 15 is rotated four or more times with the printing paper held in place by the gripper 83, each ink is transferred back to the blankets of the other colors by way of the printing paper.

In the course of this process, the quantity of ink transferred back to the first and second blanket cylinders 13 and 14 reach a point of saturation. Thus, a state of saturation may be created by using only a single sheet of printing paper, which eliminates the need to consume the printing paper in a wasteful way.

In the above process for bringing the quantity of ink to a point of saturation, the impression cylinder 15 may be rotated a plurality of times while the printing paper actually used in printing is held peripherally of the impression cylinder 15 by the gripper 83. Instead of the printing paper, for example, a sheet formed of a material effective to achieve the above back-trapping may be used.

The number of rotations of the impression cylinder 15 for bringing the quantity of ink transferred back to the first and second blanket cylinders 13 and 14 to a point of saturation may be determined beforehand with reference to printing conditions. This number of rotations may be set as appropriate or automatically in performing the above process for bringing the quantity of ink to a point of saturation. Alternatively, the quantity of ink transferred back to the first and second blanket cylinders 13 and 14 may be measured optically, and the number of rotations may be determined based on the measurement.

Further, the above process for bringing the quantity of ink to a point of saturation may be performed automatically upon start of a printing operation. In this case, the quantity of ink supplied from each ink feeder 20 to the corresponding plate P may be increased temporarily.

Where, as noted above, the impression cylinder 15 is simply rotated a plurality of times with the printing paper held in place by the gripper 83, the cyan, magenta and yellow inks are transferred back also to the K region of the first blanket cylinder 13 which essentially requires no back transfer of the inks. Similarly, the C region of the second blanket cylinder 14 receives an unnecessary back transfer of the magenta and yellow inks. The M region of the first blanket cylinder 13 receives an unnecessary back transfer of the yellow ink.

In case such back transfer of the inks affects print quality or the like, the inks may be transferred successively through the following first to third steps:

[First Step]

The black ink is transferred from the K region of the first plate cylinder 11 only to the K region of the first blanket cylinder 13. At this time, to transfer the ink only to the K region of the first blanket cylinder 13, the first and second blanket cylinders 13 and 14 may be isolated from the first and second plate cylinders 11 and 12, respectively, with regard to the other, C, M and Y regions. Alternatively, the ink may be fed from the ink feeder 20*a* only to the K region of the first plate cylinder 11. Then, by rotating the impression cylinder 15 a plurality of times with the printing paper held in place by the gripper 83, the black ink is transferred by way of the printing paper back to the C, M and Y regions of the first and second blanket cylinders 13 and 14.

[Second Step]

The cyan ink is transferred from the C region of the second plate cylinder 12 to the C region of the second blanket cylinder 14. Then, the impression cylinder 15 is rotated a plurality of times with the printing paper held in place by the gripper 83. At this time, the first plate cylinder 11 and first blanket cylinder 13 are isolated from each other with regard to the K region, so that the printing paper mounted peripherally of the impression cylinder 15 remain out of contact with the K region of the first blanket cylinder 13. As a result, the cyan ink is transferred by way of the printing paper back to the M and Y regions of the first and second blanket cylinders 13 and 14.

[Third Step]

The magenta ink is transferred from the M region of the first plate cylinder 11 to the M region of the first blanket cylinder 13. Then, the impression cylinder 15 is rotated a plurality of times with the printing paper held in place by the gripper 83. At this time, the first plate cylinder 11 and first blanket cylinder 13 are isolated from each other with regard to the K region, and the second plate cylinder 12 and second blanket cylinder 14 isolated from each other with regard to the C region, so that the printing paper mounted peripherally of the impression cylinder 15 remain out of contact with the K region of the first blanket cylinder 13 and the C region of the second blanket cylinder 14. As a result, the magenta ink is transferred by way of the printing paper back to the Y region of the second blanket cylinder 14.

In this way, the above-noted unnecessary back transfer of the inks may be avoided by successively transferring back the inks through the first to third steps described above.

In the first to third steps described above, the impression cylinder 15 may be rotated a plurality of times without changing the printing paper. The impression cylinder 15 may be rotated a plurality of times with the printing paper changed for each step.

The first to third steps described above may be executed in the reverse order. In this case, it is necessary to rotate the impression cylinder 15 a plurality of times with the printing paper changed for each step.

In the above multi-color offset printing apparatus, each of the plates P mounted on the first and second plate cylinders 11 and 12 has two image areas 67*a* and 67*b* or 67*c* and 67*d*, and the impression cylinder 15 used has half the diameter of the first and second plate cylinders 11 and 12 and the first and second blanket cylinders 13 and 14. The present invention is not limited to these features.

Figure 8:
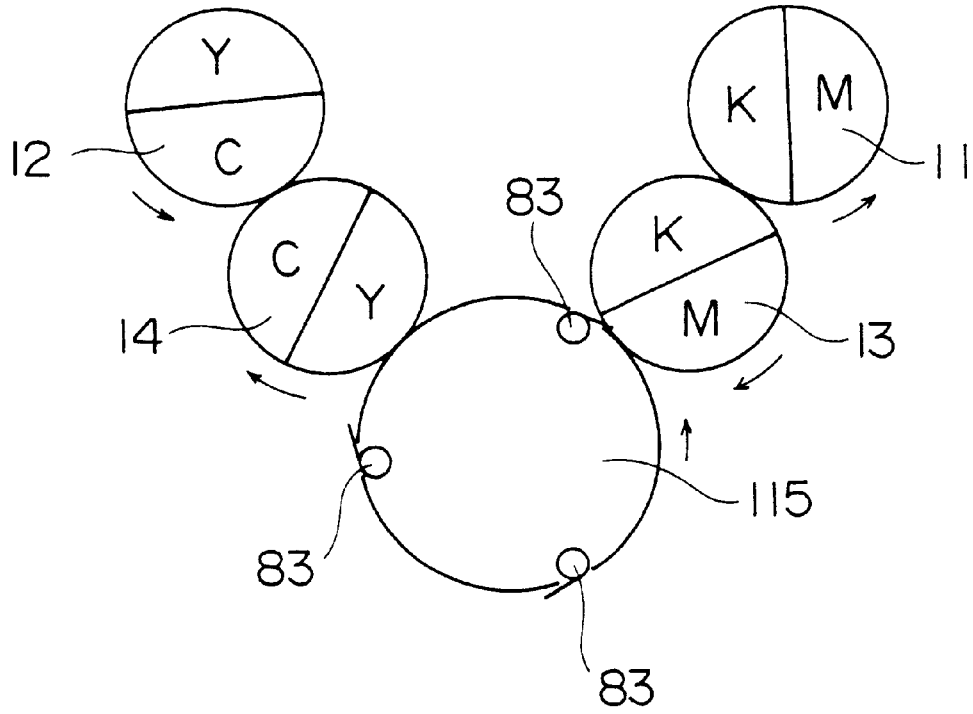
FIG. 8 is an explanatory view of a multi-color offset printing apparatus in another embodiment of the invention.

FIG. 8 is an explanatory view of a multi-color offset printing apparatus in another embodiment of the invention. Of the entire printing apparatus, FIG. 8 shows only an impression cylinder 115, along with the first and second plate cylinders 11 and 12 and the first and second blanket cylinders 13 and 14 which are the same as in the multi-color offset printing apparatus shown in FIG. 1. The other aspects of the construction are the same as in the printing apparatus shown in FIG. 1.

In this multi-color offset printing apparatus, the impression cylinder 115 is 3/2 in diameter of the first and second plate cylinders 11 and 12 and the first and second blanket cylinders 13 and 14. Thus, the first and second plate cylinders 11 and 12 and the first and second blanket cylinders 13 and 14 make three rotations for every two rotations of the impression cylinder 115. This impression cylinder 115 has three grippers 83 arranged at equal intervals peripherally thereof for holding three sheets of printing paper.

In a printing operation of this printing apparatus, with two rotations of the impression cylinder 115 carrying three sheets of printing paper, the three sheets are printed in the four colors of yellow, magenta, cyan and black. The four-color printing may be performed continuously by feeding three new sheets of printing paper from the paper feed cylinder 16 shown in FIG. 1 for every two rotations of the impression cylinder 115.

In this multi-color offset printing apparatus, as in the printing apparatus shown in FIG. 1, upon start of a printing operation, the impression cylinder 115 may be rotated four or more times with three sheets of printing paper held in place by the grippers 83. Consequently, a state of saturation as described hereinbefore is created by using only three sheets of printing paper, which eliminates the need to consume the printing paper in a wasteful way.

Figure 9:
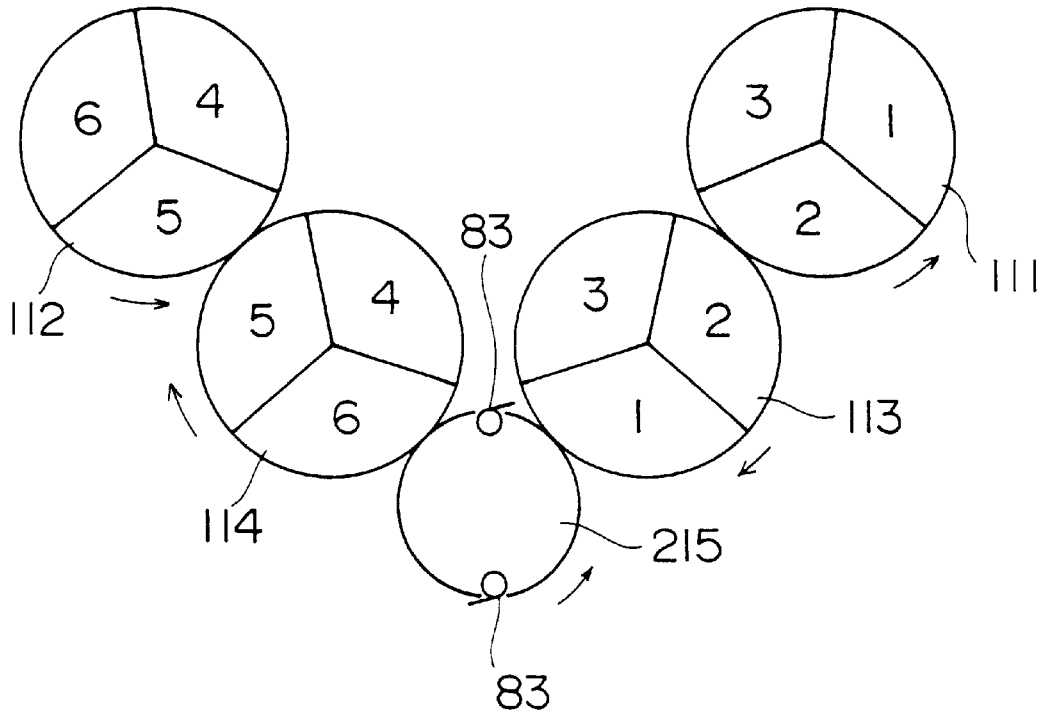
FIG. 9 is an explanatory view of a multi-color offset printing apparatus in a further embodiment of the invention.

FIG. 9 is an explanatory view of a multi-color offset printing apparatus in a further embodiment of the invention. Of the entire printing apparatus, FIG. 9 shows only an impression cylinder 215, first and second plate cylinders 111 and 112 and first and second blanket cylinders 113 and 114. Though not shown in FIG. 9, three ink feeders similar to the ink feeders 20 shown in FIG. 1 are arranged outwardly of each of the first and second plate cylinders 111 and 112. The other aspects of the construction are the same as in the printing apparatus shown in FIG. 1.

In this multi-color offset printing apparatus, the impression cylinder 215 is 2/3 in diameter of the first and second plate cylinders 111 and 112 and the first and second blanket cylinders 113 and 114. Thus, the first and second plate cylinders 111 and 112 and the first and second blanket cylinders 113 and 114 make two rotations for every three rotations of the impression cylinder 215. The first plate cylinder 111 has three image areas formed thereon (or three plates each with a single image area mounted thereon) for printing with a first to a third color inks. The second plate cylinder 112 has three image areas formed thereon (or three plates each with a single image area mounted thereon) for printing with a fourth to a sixth color inks. The impression cylinder 215 has two grippers 83 arranged in diametrically opposed positions peripherally thereof for holding two sheets of printing paper.

In a printing operation of this multi-color offset printing apparatus, with three rotations of the impression cylinder 215 carrying two sheets of printing paper, the two sheets are printed in six colors, using the first to sixth color inks. The six-color printing may be performed continuously by feeding two new sheets of printing paper from the paper feed cylinder 16 shown in FIG. 1 for every three rotations of the impression cylinder 215. This printing operation uses, besides the usual four color inks, inks of other colors called special colors, clear varnish or the like.

In this multi-color offset printing apparatus, as in the printing apparatus shown in FIG. 1, upon start of a printing operation, the impression cylinder 215 may be rotated six or more times with two sheets of printing paper held in place by the grippers 83. Consequently, a state of saturation as described hereinbefore is created by using only two sheets of printing paper, which eliminates the need to consume the printing paper in a wasteful way.

In each of the multi-color offset printing apparatus described hereinbefore, plates P each having a plurality of image areas are mounted on the first and second plate cylinders 11 and 12 or 111 and 112. This feature may be modified such that plates P each having a single image area are mounted on the first and second plate cylinders 11 and 12 or 111 and 112.

Further, each of the foregoing multi-color offset printing apparatus prints the printing paper mounted peripherally of the single impression cylinder 15, 115 or 215 by using the first and second plate cylinders 11 and 12 or 111 and 112 and the first and second blanket cylinders 13 and 14 or 113 and 114. The present invention is not limited to such a construction. A printing operation may be carried out by using a single plate cylinder and a single blanket cylinder.

Figure 10:
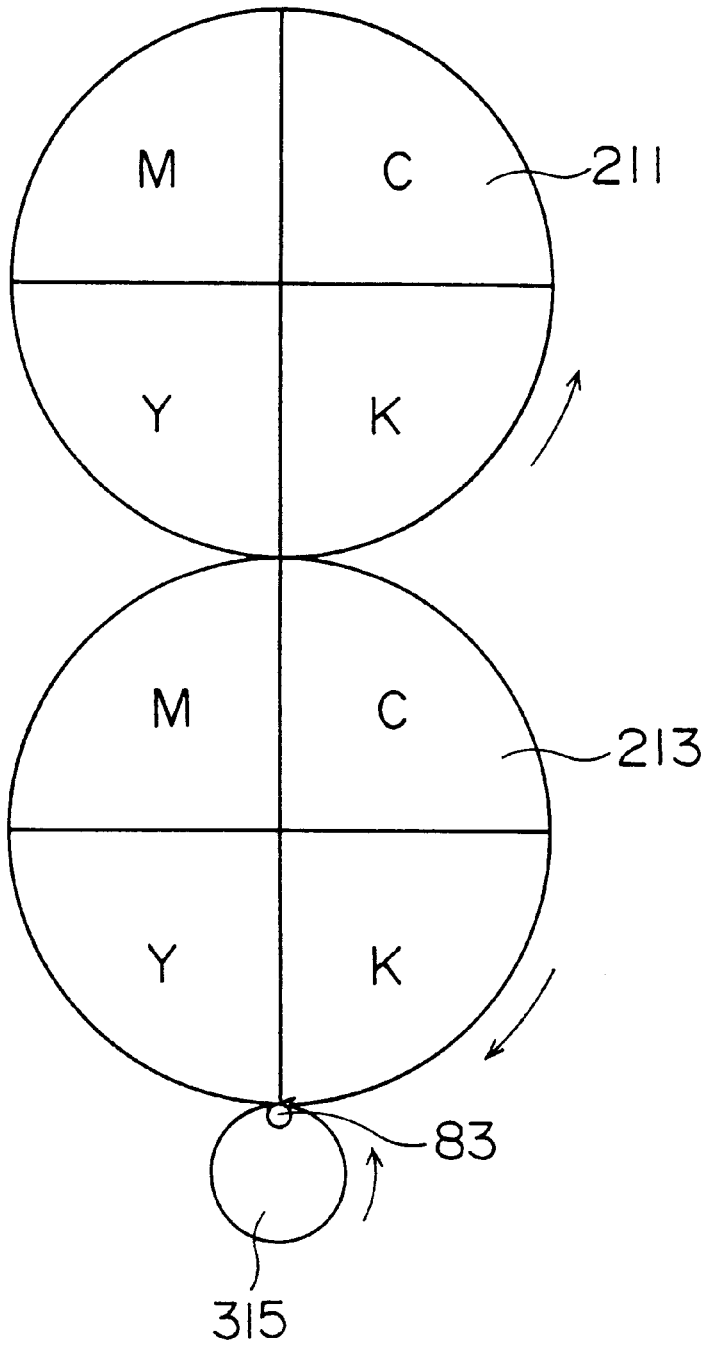
FIG. 10 is an explanatory view of a multi-color offset printing apparatus in a still further embodiment of the invention.

FIG. 10 is an explanatory view of a multi-color offset printing apparatus in such an embodiment. Of the entire printing apparatus, FIG. 10 shows only an impression cylinder 315, a plate cylinder 211 and a blanket cylinder 213. Though not shown in FIG. 10, four ink feeders similar to the ink feeders 20 shown in FIG. 1 are arranged outwardly of the plate cylinder 211. The other aspects of the construction are the same as in the printing apparatus shown in FIG. 1.

In this multi-color offset printing apparatus, the impression cylinder 315 is 1/4 in diameter of the plate cylinder 211 and blanket cylinder 213. Thus, the plate cylinder 211 and blanket cylinder 213 make one rotation for every four rotations of the impression cylinder 315. The plate cylinder 211 has four image areas formed thereon (or four plates each with a single image area mounted thereon) for printing with the black, cyan, magenta and yellow inks. The impression cylinder 315 has a gripper 83 disposed peripherally thereof for holding printing paper.

In a printing operation of this multi-color offset printing apparatus, with four rotations of the impression cylinder 315 carrying the printing paper, the printing paper is printed in the four colors of black, cyan, magenta and yellow. The four-color printing may be performed continuously by feeding new printing paper from the paper feed cylinder 16 shown in FIG. 1 for every four rotations of the impression cylinder 215.

In this multi-color offset printing apparatus, as in the printing apparatus shown in FIG. 1, upon start of a printing operation, the impression cylinder 315 may be rotated eight or more times with the printing paper held in place by the gripper 83. Consequently, a state of saturation as described hereinbefore is created by using only one sheet of printing paper, which eliminates the need to consume the printing paper in a wasteful way.

In the embodiment shown in FIG. 10, the plate cylinder 211 has four image areas formed thereon. However, the number of image areas may be any number two or more.

The present invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 10-274422 filed in the Japanese Patent Office on Sep. 9, 1998, the entire disclosure of which is incorporated herein by reference.

What is claimed is:

1. A multi-color offset printing method for performing multi-color printing by feeding color inks, respectively, to a plurality of corresponding image areas on a plate cylinder, transferring the color inks through a blanket cylinder to printing paper in a predetermined order of colors, said method comprising:

an ink feeding step for feeding the color inks from ink feeders opposed to said plate cylinder with n image areas disposed peripherally thereof wherein n is a single selected integer selected from a group of integers consisting of 2, 3 and 4 and, each color ink corresponding to a respective image area;

an ink transferring step for transferring said color inks from said image areas to said blanket cylinder equal in diameter to said plate cylinder and rotating in contact with said plate cylinder;

an ink adjusting step for rotating an impression cylinder at least 2n times, said impression cylinder having a sheet mounted peripherally thereof and rotating in contact with said blanket cylinder; and a printing step for feeding printing paper to an outer periphery of said impression cylinder rotating in contact with said blanket cylinder, and discharging said printing paper from said outer periphery of said impression cylinder after rotating said impression cylinder n times.

2. A multi-color offset printing method as defined in claim 1, wherein said plate cylinder has a single plate mounted peripherally thereof and defining n image areas.

3. A multi-color offset printing method as defined in claim 1, wherein said plate cylinder has n plates mounted peripherally thereof and each defining a single image area.

4. A multi-color offset printing method as defined in claim 1, wherein said ink transferring step is executed for causing only one of said image areas corresponding to a succeeding one of said color inks in the order of colors to contact said blanket cylinder.

5. A multi-color offset printing apparatus for performing multi-color printing by feeding color inks, respectively, to a plurality of corresponding image areas on a plate cylinder, transferring the color inks through a blanket cylinder to printing paper in a predetermined order of colors, said apparatus comprising:

a plate cylinder with n image areas disposed peripherally thereof wherein n is a single selected integer selected from a group of integers consisting of 2, 3 and 4;

a blanket cylinder equal in diameter to said plate cylinder and rotatable in contact with said plate cylinder;

an impression cylinder having a gripper disposed peripherally thereof for holding a forward end of printing paper, said impression cylinder being rotatable in contact with said blanket cylinder; and a controller for rotating said impression cylinder at least 2n times, with said gripper holding a sheet.

6. A multi-color offset printing apparatus as defined in claim 5, wherein said plate cylinder is constructed for supporting a single plate mounted peripherally thereof and defining n image areas.

7. A multi-color offset printing apparatus as defined in claim 5, wherein said plate cylinder is constructed for supporting n plates mounted peripherally thereof and each defining a single image area.

8. A multi-color offset printing apparatus as defined in claim 5, further comprising:

a second plate cylinder with n image areas disposed peripherally thereof wherein n is an integer 2, 3 or 4, said second plate cylinder equal in diameter to said plate cylinder; and a second blanket cylinder equal in diameter to said second plate cylinder and rotatable in contact with said second plate cylinder, said second blanket cylinder being rotatable also in contact with said impression cylinder.

9. A multi-color offset printing method for performing multi-color printing by feeding color inks, respectively, to a plurality of corresponding image areas on a plate cylinder, transferring the color inks through a blanket cylinder to printing paper in a predetermined order of colors, said method comprising:

an ink feeding step for feeding the color inks from ink feeders opposed to said plate cylinder with two image areas disposed peripherally, each color ink corresponding to a respective image area;

an ink transferring step for transferring said color inks from said image areas to said blanket cylinder equal in diameter to said plate cylinder and rotating in contact with said plate cylinder;

an ink adjusting step for rotating an impression cylinder four times, said impression cylinder having a sheet mounted peripherally thereof and rotating in contact with said blanket cylinder; and a printing step for feeding printing paper to an outer periphery of said impression cylinder rotating in contact with said blanket cylinder, and discharging said printing paper from said outer periphery of said impression cylinder after rotating said impression cylinder two times.

* * * * *